US005214256A

United States Patent [19]

Ipcinski

[11] Patent Number: 5,214,256

[45] Date of Patent: May 25, 1993

[54] MEMBRANE TYPE SWITCH WITH IMPROVED ELASTOMERIC ACTUATOR INCLUDING A CAP MOUNTED IN AN ACTUATOR DEPRESSION

[76] Inventor: Ralph Ipcinski, 295 Silver Lake Rd., Hollis, N.H. 03049

[21] Appl. No.: 915,788

[22] Filed: Jul. 17, 1992

Related U.S. Application Data

[63] Continuation-in-part of Ser. No. 665,573, Feb. 27, 1991, abandoned.

[51] Int. Cl.[5] ..... H01H 1/10; H01H 13/70

[52] U.S. Cl. ..... 200/5 A; 200/512

[58] Field of Search ..... 200/5 A, 512-517, 200/314, 341-345

[56] References Cited

U.S. PATENT DOCUMENTS

| | | | |
|---|---|---|---|
| 3,806,673 | 4/1974 | Boulanger | 200/5 A |
| 3,829,646 | 8/1974 | Lorteije et al. | 200/345 X |
| 4,029,916 | 6/1977 | Chu | 200/5 A |
| 4,035,593 | 7/1977 | Riniker | 200/5 A |
| 4,400,596 | 8/1983 | Fukukura et al. | 200/5 A |
| 4,439,647 | 3/1984 | Calandrello et al. | 200/5 A |
| 4,710,597 | 12/1987 | Loheac | 200/5 A |
| 4,845,319 | 7/1989 | Watkins et al. | 200/5 A |

*Primary Examiner*—J. R. Scott

[57] ABSTRACT

The switch includes a cap, a base portion, a dome retainer subassembly and a support portion. The base portion includes an upper surface and an actuator block. The cap and actuator block are located within a depression of the base portion formed by sides of the base upper surface. The dome retainer subassembly and the support portion are mounted in superposed abutting relation with respect to the cap and the base portion. Pressure on the cap causes at least one movable dome contact of the dome retainer subassembly to electrically engage corresponding first and second contacts located on the support portion facing surface.

5 Claims, 8 Drawing Sheets

MEMBRANE TYPE SWITCH WITH IMPROVED ELASTOMERIC ACTUATOR INCLUDING A CAP MOUNTED IN AN ACTUATOR DEPRESSION

This is a continuation-in-part of application Ser. No. 07/665,573 filed on Feb. 27, 1991 now abandoned.

BACKGROUND OF THE INVENTION

Field of the Invention

This invention relates to electrical switches and more specifically to an electric switch utilizing an elastomer actuator. This sealed switch is engagable with a front panel, uses highly solvent resistant plastic and is shock resistant and water proof.

SUMMARY OF THE INVENTION

A switch comprising a cap, a base portion, a movable contact retainer subassembly and a support portion. The base portion has an upper surface on which the cap rests in superposed abutting relation. In turn the base portion lies in superposed abutting relation to the movable contact retainer subassembly. To complete the assembly of the switch, the subassembly of the cap, the base portion and the dome retainer subassembly is positioned in superposed abutting relation to the facing surface of the support portion. The base portion is formed of an elastomeric material and the movable actuator retainer subassembly comprises a spacer and a membrane seal. The spacer is formed of a double sided adhesive material, one side of which is adhered to the membrane seal.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
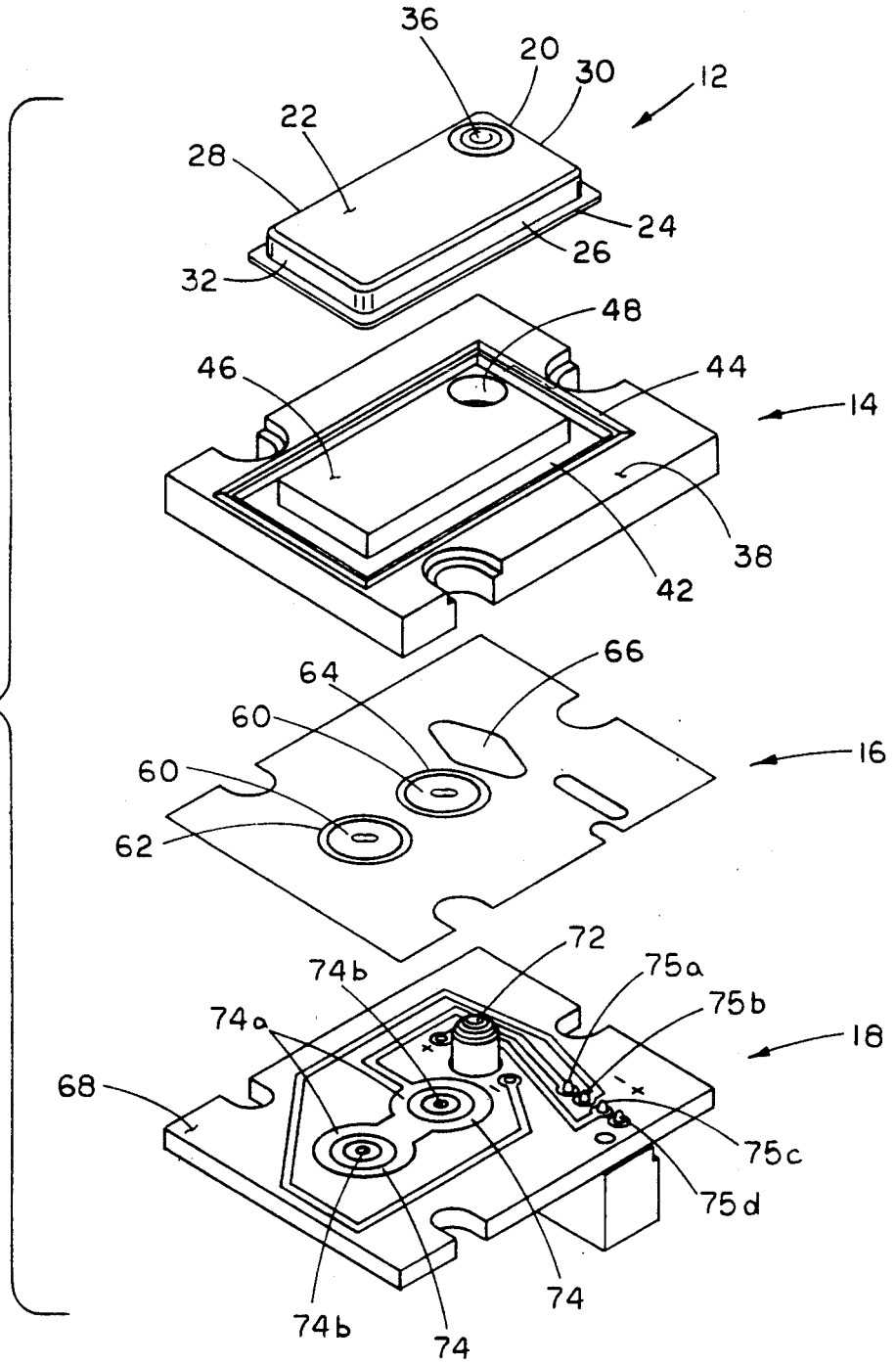
FIG. 1 is an exploded view of an electric switch according to the present invention.

There is shown in the drawing a switch 10 including a cap 12, a base portion 14, a dome retainer subassembly 16 and a support portion 18.

Figure 3:
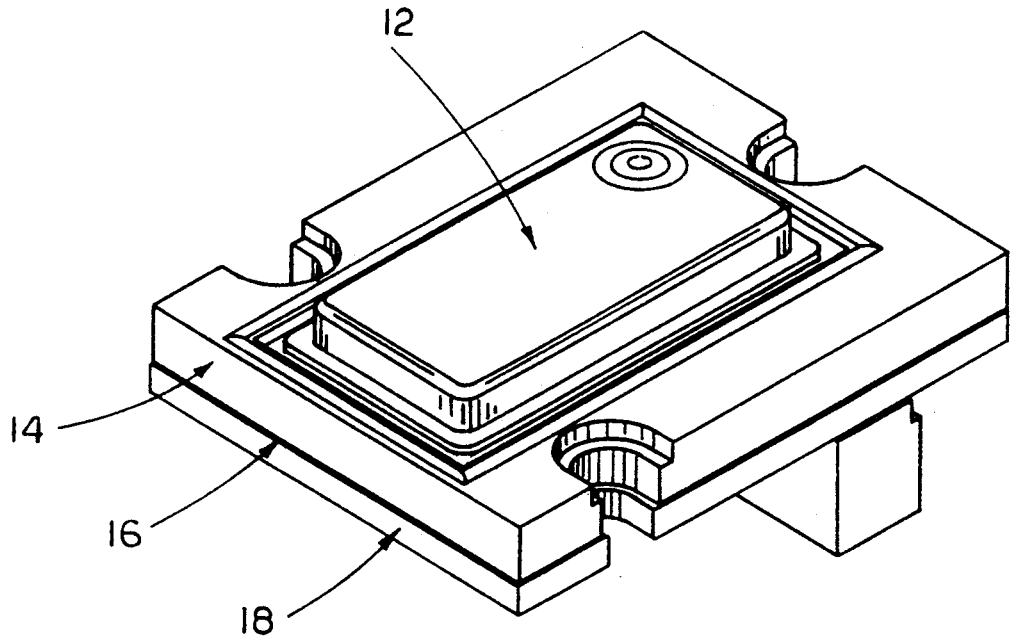
FIG. 3 is a perspective view of the electric switch shown in FIG. 1 from the topside.
Figure 4:
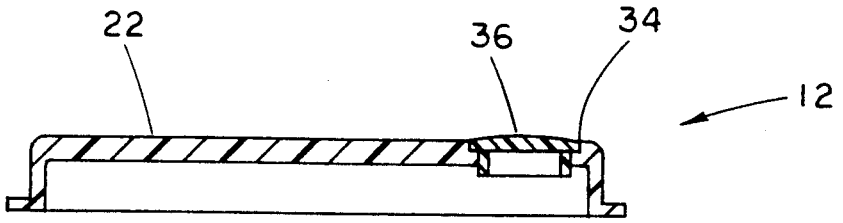
FIG. 4 is a sectional view of the cap of the electric switch shown in FIG. 1.

The cap 12 comprises a rectangular, hollow housing portion 20 formed of an opaque material, having a top surface 22 and a shoulder portion 24. The top surface 22 has a first long wall 26 extending from a long side of the top surface 22, a second long wall 28 extending from the other long side of the top surface 22, a first short wall 30 extending from a short side of the top surface 22, and a second short wall 32 extending from the other short side of the top surface 22. The first and second long walls 26, 28 are in spaced parallel relation to each other and are connected at their ends by the first and second short walls 30, 32 to provide with the top surface 22, a box like configuration. The shoulder portion 24 extends from the walls 26, 28, 30, 32 around the periphery of the cap 12 as shown in FIGS. 1, 3 and 4. An aperture 34 is formed through the top surface 22 and has a red translucent insert 36 press fitted therein.

Figure 5:
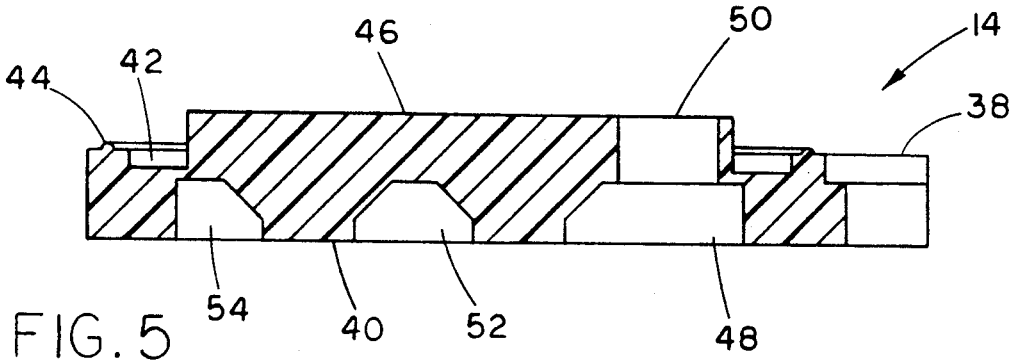
FIG. 5 is a sectional view of the base portion of the electric switch shown in FIG. 1.
Figure 6:
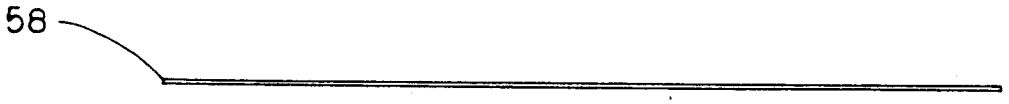
FIG. 6 is a side elevational view of a membrane seal used with the electric switch shown in FIG. 1.

The base portion 14 is generally rectangular in configuration, formed of an translucent elastomeric material, such as a silicon rubber and comprising an upper surface 38 and a lower surface 40. The upper surface 38 has a centrally formed, rectangular depression 42 whose sides provide a circumferential step 44. A rectangular actuator block 46 is positioned within the depression 42 as shown in FIG. 1. An internally shouldered hole 48 is formed through the actuator block 46 for a purpose to be described hereinafter. A translucent membrane 50 covers the opening, to the hole 48 in close proximity to the upper surface 38. A first recess 52 is formed in the lower surface 40 spaced from and in close proximity to a second recess 45 as shown in FIG. 5.

Figure 7:
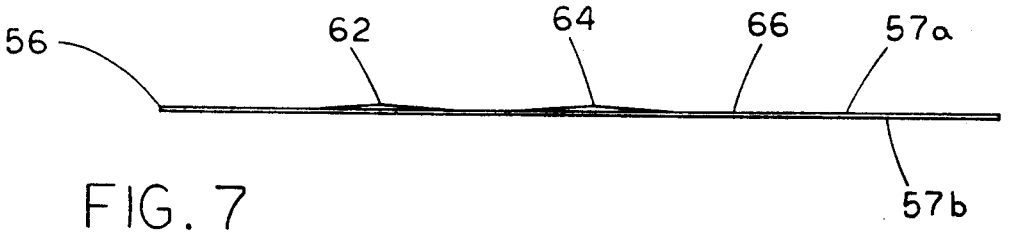
FIG. 7 is a side elevational view of a spacer used with the electric switch shown in FIG. 1.
Figure 8:
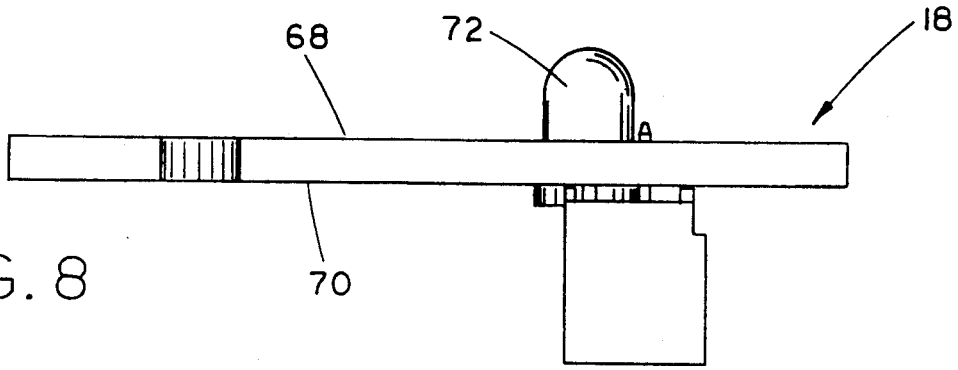
FIG. 8 is a side elevational view of a support portion used with the electric switch shown in FIG. 1.
Figure 9:
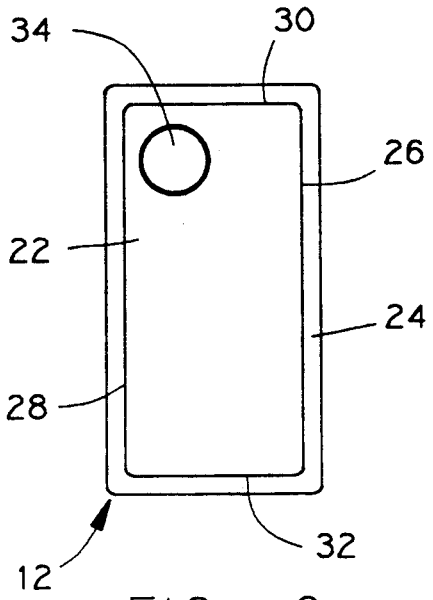
FIG. 9 is a top plan view of a cap of a variation of the switch shown in FIGS. 1–8.
Figure 10:
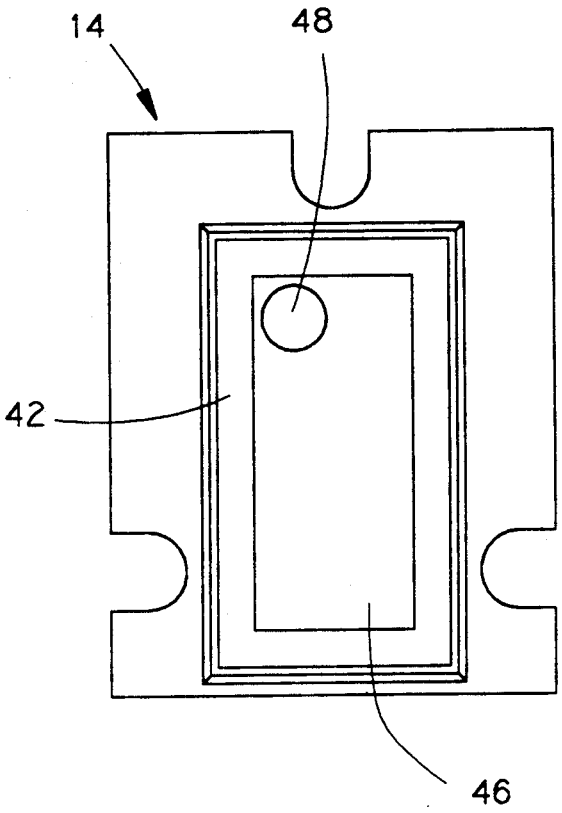
FIG. 10 is a top plan view of the base portion of a variation of the switch shown in FIGS. 1–8.
Figure 11:
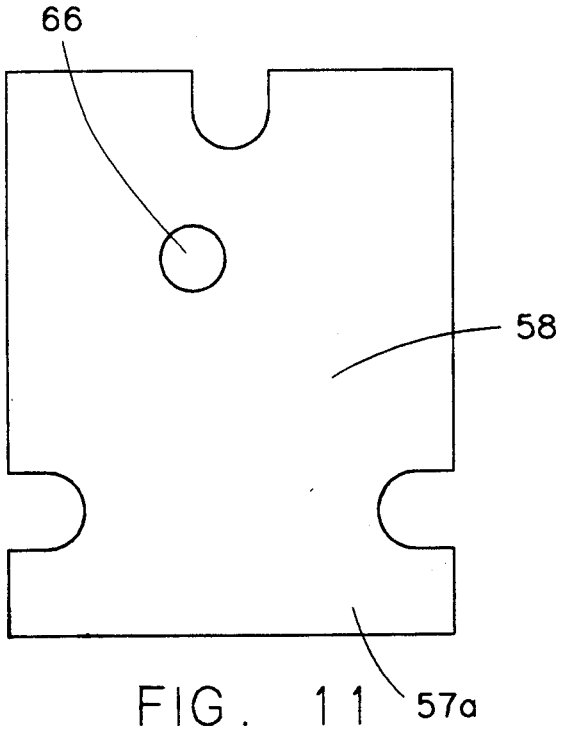
FIG. 11 is a top plan view of the membrane seal of the movable contact retainer subassembly of a variation of the switch shown in FIGS. 1–8.
Figure 12:
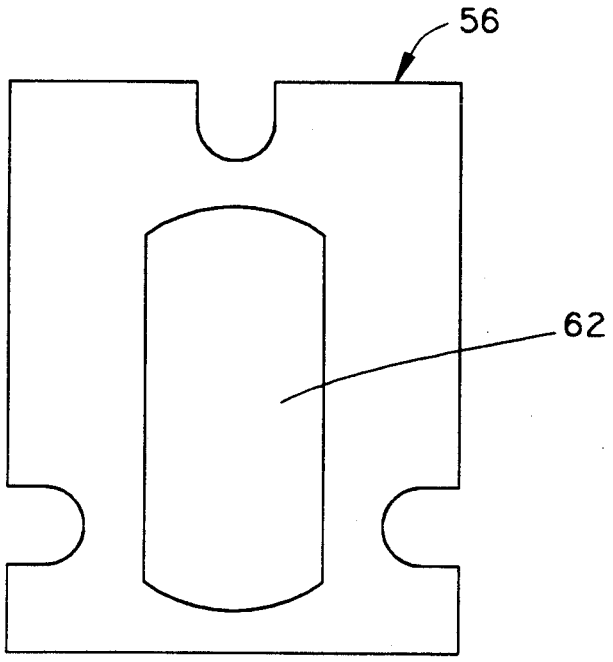
FIG. 12 is a top plan view of the spacer of the movable contact retainer subassembly of a variation of the switch shown in FIGS. 1–8.

The dome retainer subassembly 16, generally rectangular in configuration, is of three piece construction including a spacer 56, a membrane seal 58 and a pair of dome actuators 60. The spacer 56 is formed of a plastic material, MYLAR for example, which has adhesive on each side 57*a*, 57*b*. A first through aperture 62 is formed on the midline of the spacer 56, as is a second through aperture 64 and a third through aperture 66. The apertures 62, 64, 66 are aligned and in spaced relation to each other as shown in FIG. 1 and indicated in FIG. 7. The dome actuators 60 are contacts formed of an electrically conductive material, and one contact is press fitted into the first through aperture 62 and the other contact is press fitted into the second through aperture 64. The dome actuators 60 extend above the upper surface of the spacer 56. The membrane seal 58 is formed of a thin plastic material, MYLAR for example. The membrane seal 58 is pressed onto the spacer 56 and the assembled dome actuators 60 forming the dome retainer subassembly 16.

Figure 2:
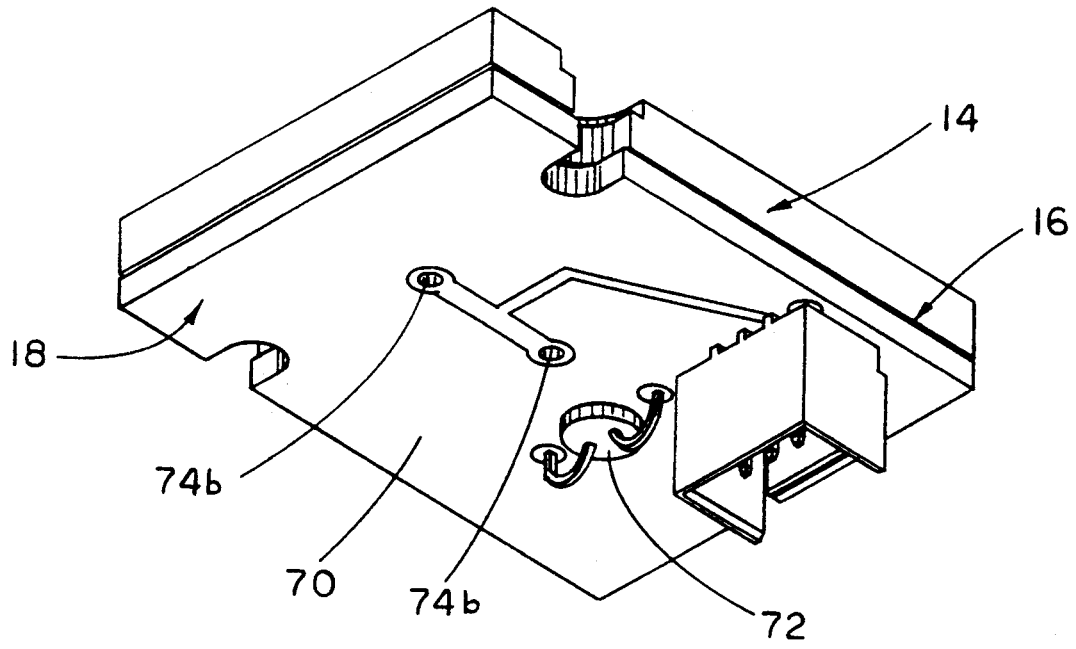
FIG. 2 is a perspective view of the electric switch shown in FIG. 1 from the underside.

The support portion 18 includes a facing surface 68 on one side thereof and a base surface 70 on the otherside thereof. The facing surface 68 includes printed circuitry for actuating an LED 72 and for performing the required switching functions. A pair of spaced fixed contact areas 74 include an outer circle 74*a* and a plated through hole 74*b* which is not electrically connected to the outer circle 74*a*. The four spaced terminals 75*a*, 75*b*, 75*c*, and 75*d* extend through the support portion 18 as indicated at FIG. 2. The terminal 75*a* is electrically connected to the outer circles 74*a*. The plated through holes 74*b* are connected together on the base surface 70 and to the terminal 75*d* as indicated in FIG. 2. The plus and minus terminals 75*b*, 75*c* are connected to the LED and to an external circuitry. The terminals 75*a* and 75*b* are also connected to external circuitry not shown. The design of the outer circles 74*a* is utilized in this embodiment because of the rectangular configuration of the cap 12.

The base surface 70 includes an connector 71 whose terminals 75*a*, 75*b*, 75*c*, and 75*d* extend through the facing surface 68 of the support portion 70 s indicated in FIGS. 1, 2, 3, and 8.

To assemble the switch 10, the dome retainer subassembly 16 is attached to the support portion 18 by pressing the adhesive side 57*b* of the spacer 56 against the facing surface 68 of the support portion 18. An aperture 73 is formed through the support portion 18. The LED 72 is passed through the aperture 73 of the support portion 18 and thence through the opening 66 in the membrane 58. The base portion 14 is then positioned over the dome retainer subassembly 16 with the wall of the first recess 52 of the lower surface 40 of the actuator block 46 bearing against one of the dome actuators 60 and the wall of the second recess 54 bearing against the other of the dome actuators 60. The lower surface 40 of the base portion 14 is adhered to the uppermost surface of the membrane seal 58. This could be accomplished by having adhesive on the uppermost surface of the membrane seal 58. Obviously there are other well known methods for accomplishing the same purpose. The LED 72 extends through the hole 48. The cap 12, which may be formed of a poly etheramide, is press fitted within the depression 42 with the shoulder portion 24 abutting the step 44.

When the cap 12 is depressed, by an operator, it deforms the actuator block 46 which applies force on the dome actuators 60 thereby engaging and electrically bridging the fixed contact areas 74*a*, 74*b* completing an electric circuit. When the pressure on the cap 12 is released, the actuator block 46 returns to its initial form prior to deformation.

Figure 16:
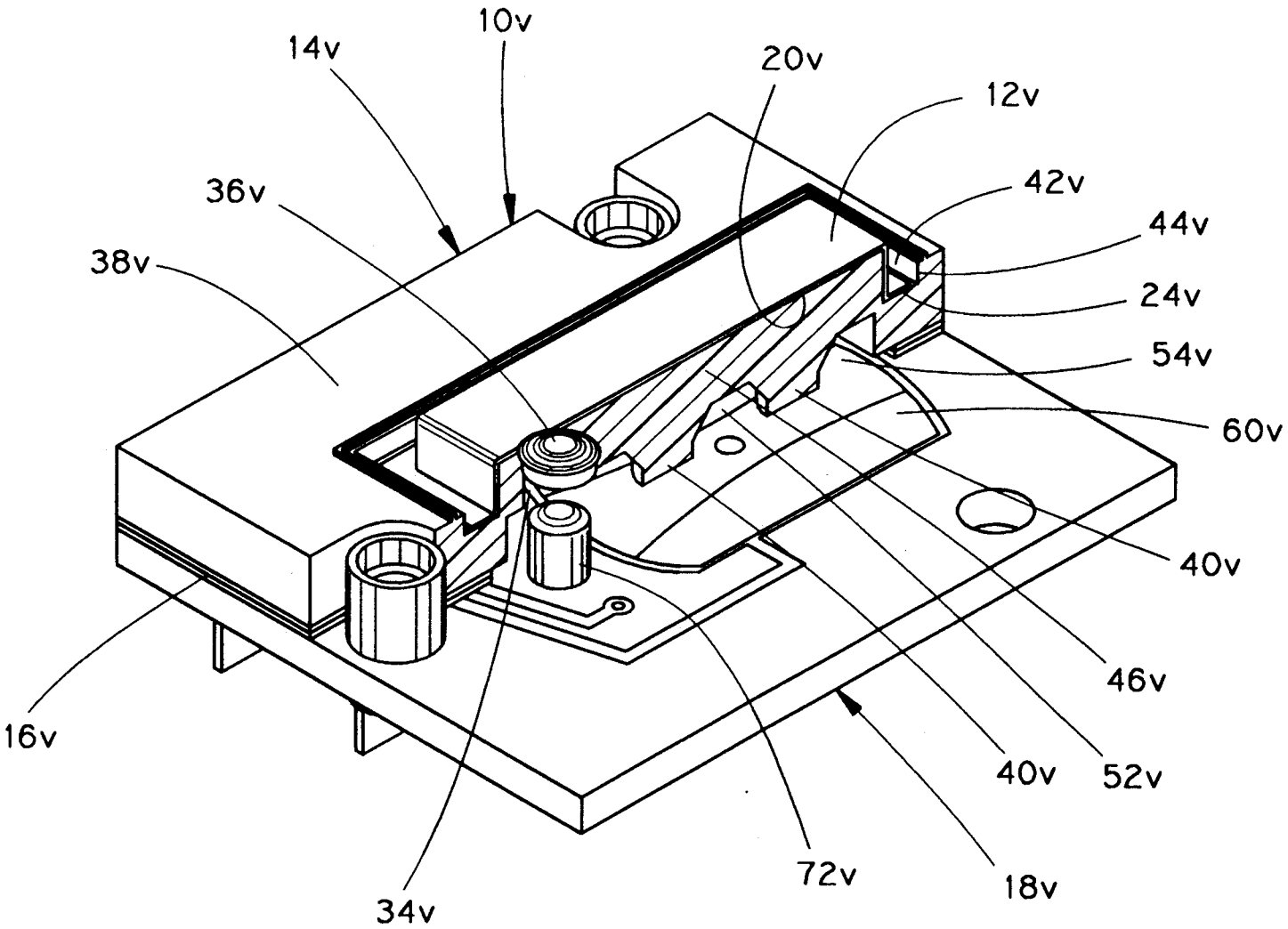
FIG. 16 is a perspective view of the switch variation partly in section according to the present invention.

There is shown in the drawing at FIG. 16 a switch 10V including a cap 12V, a base portion 14V, a movable contact retainer subassembly 16V and a support portion 18V.

The cap 12V comprises a rectangular, hollow housing portion 20V formed of an opaque material, having a top surface 22V and a shoulder portion 24V. The top surface 22V has a first long wall 26V extending from a long side of the top surface 22V, a second long wall 28V extending from the other long side of the top surface 22V, a first short wall 30V extending from a short side of the top surface 22V, and a second short wall 32V extending from the other short side of the top surface 22V. The first and second long walls 26V, 28V are in spaced parallel relation to each other and are connected at their ends by the first and second short walls 30V, 32V to provide with the top surface 22V, a box like configuration. The shoulder portion 24V extends from the walls 26V, 28V, 30V, 32V around the periphery of the cap 12V as shown in FIG. 16. An aperture 34V is formed through the top surface 22V and has a red translucent insert 36V press fitted therein.

The base portion 14V is generally rectangular in configuration, formed of an translucent elastomeric material, such as a silicon rubber and comprising an upper surface 38V and a lower surface 40V. The upper surface 38V has a centrally formed, rectangular depression 42V whose sides provide a circumferential step 44V. A hollow, rectangular actuator block 46V is positioned within the depression 42V as shown in FIG. 16. An internally shouldered hole 48V is formed through the actuator block 46V for a purpose to be described hereinafter. A first actuator element 52V is formed in the lower surface 40V spaced from and in close proximity to a second actuator element 54V as shown in FIG. 16.

The movable contact retainer subassembly 16V, generally rectangular in configuration, is of three piece construction including a spacer 56V, a membrane seal 58V and a single, enlarged dome actuator 60V. The spacer 56V is formed of a series of layers of plastic film, FLEXCON for example, which are adhered to each other by a film of adhesive covered prior to assembly with a release liner 57*a*V, 57*b*V, on each external side of the spacer 56V. A large first through aperture 62V is formed on the midline of the spacer 56. The dome actuator 60V is formed of an electrically conductive material, is press fitted into the first through aperture 62V, and comprises the movable contact. The dome actuator 60V extend above the upper surface of the spacer 56V. The membrane seal 58V is formed of a thin plastic material, MYLAR for example and includes a through opening 66V which is positioned under the first through aperture 62V. The membrane seal 58V is pressed onto the spacer 56V and the assembled dome actuator 60V after the adhesive release liner 57*a*V is removed completing the dome retainer subassembly 16V.

Figure 13:
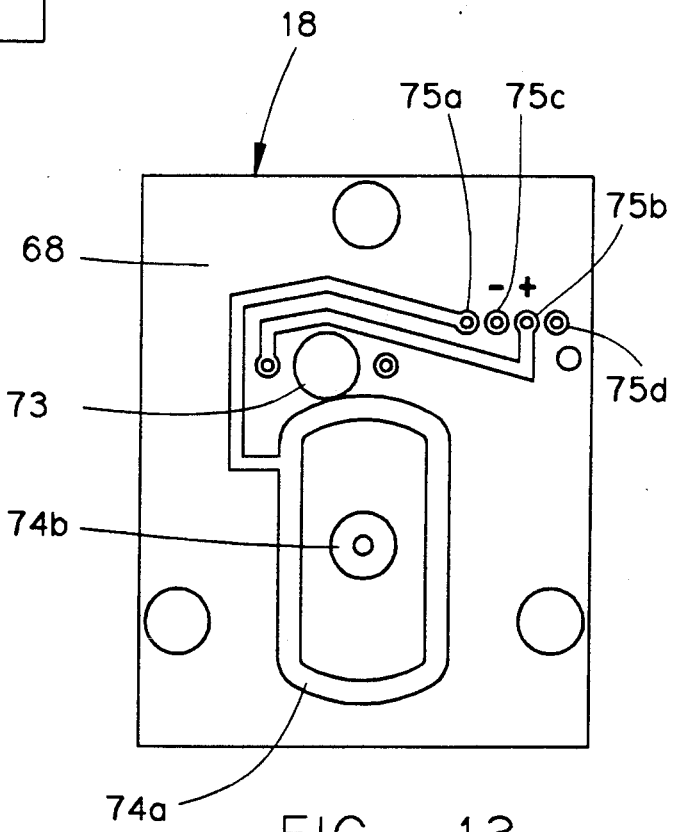
FIG. 13 is a top plan view of the support portion of a variation of the switch shown in FIGS. 1–8.
Figure 14:
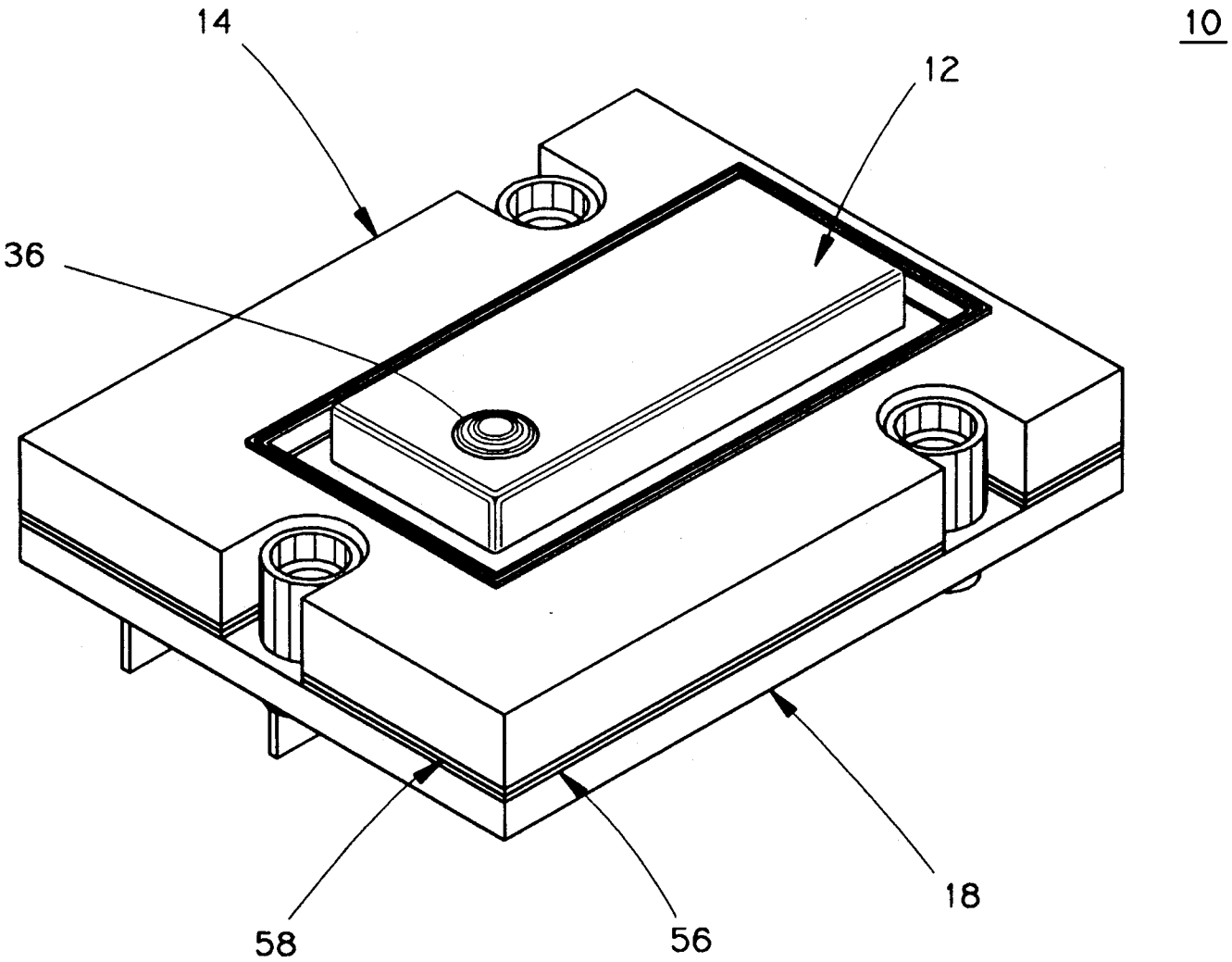
FIG. 14 is a top perspective view of a variation of the switch shown in FIGS. 1–8.
Figure 15:
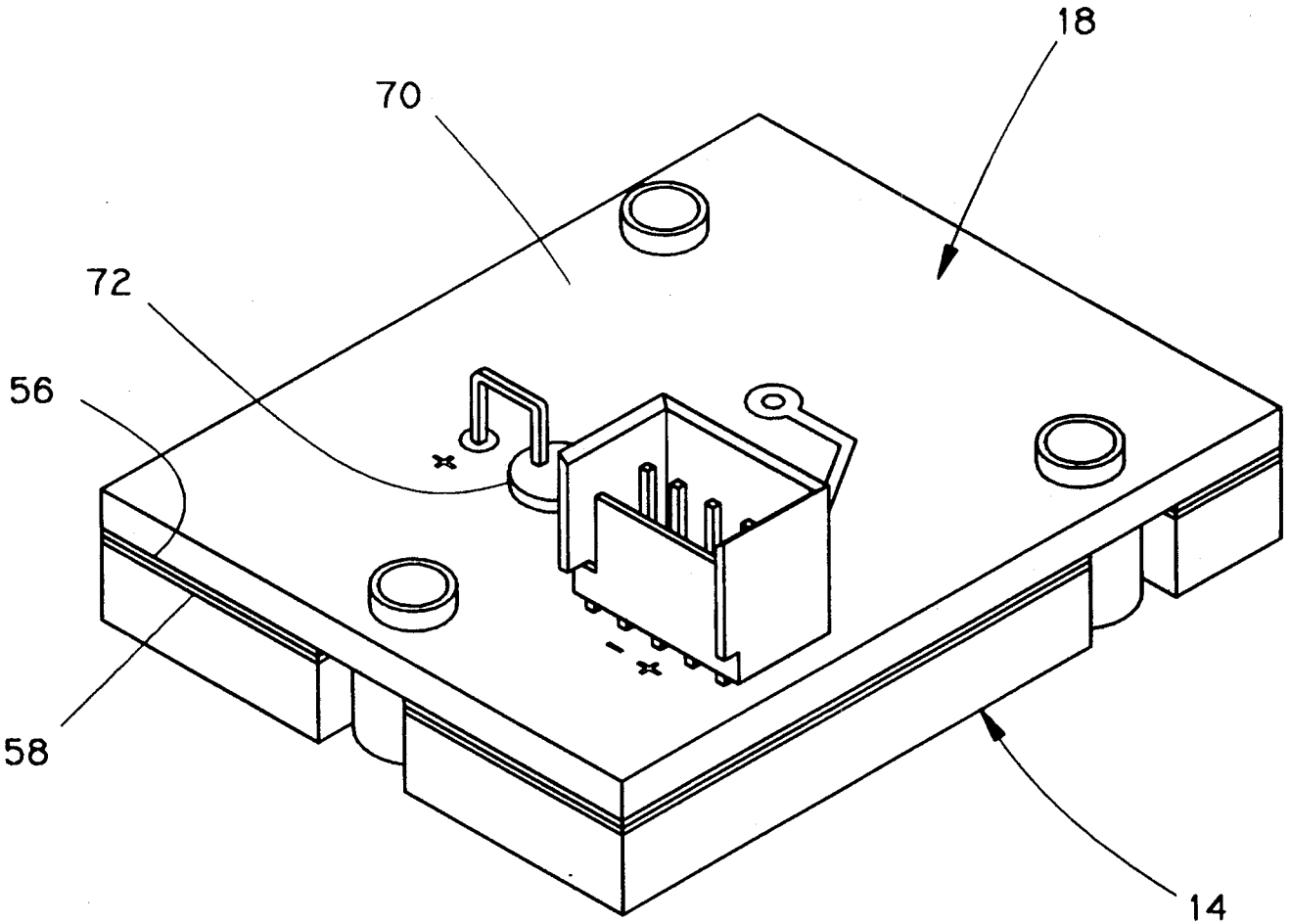
FIG. 15 is a bottom perspective view of a variation of the switch shown in FIGS. 1–8.

The support portion 18V includes a facing surface 68V on one side thereof and a base surface 70V on the other side thereof. The facing surface 68V has printed circuitry for actuating an LED 72V and for performing the required switching functions. A fixed contact area includes an outer closed geometric figure or first fixed contact 74*a*V and a plated through hole or second fixed contact 74*b*V which is not electrically connected to the outer figure 74*a*V and which is circumscribed by it. The four spaced terminals 75*a*V, 75*b*V, 75*c*V, and 75*d*V extend through the support portion 18V as indicated at FIG. 13. The terminal 75*a*V is electrically connected to the outer figure 74*a*V. The plated through hole 74*b*V is connected to the terminal 75*d*V. The plus and minus terminals 75*b*V, 75*c*V are connected to the LED and to an external circuitry. The terminals 75*a*V and 75*b*V are also connected to external circuitry not shown. The design of the outer figure 74*a*V is utilized in this embodiment because of the generally rectangular configuration of the dome actuator 60V. An aperture 73V is formed through the support portion 18. The base surface 70V includes an open housing 71V which circumscribes the terminals 75*a*V, 75*b*V, 75*c*V, and 75*d*V as shown in FIG. 15.

To assemble the switch 10V, the dome retainer subassembly 16V is attached to the support portion 18V by pressing the adhesive side 57*b*V of the spacer 56V against the facing surface 68V of the support portion 18V. The LED 72V is passed through the aperture 73V of the support portion 16V, the first through aperture 62V of the spacer 56V, and thence through the opening 66V in the membrane 58V. The base portion 14V is then positioned over the dome retainer subassembly 16V with the wall of the first actuator element 52V and the second actuator element 54V of the lower surface 40V of the actuator block 46V bears against the dome actuator 60V and the wall of the second recess 54V bearing against the other of the dome actuators 60V. The lower surface 40V of the base portion 14V is adhered to the uppermost surface of the membrane seal 58V. This could be accomplished by having adhesive on the uppermost surface of the membrane seal 58V. Obviously there are other well known methods for accomplishing the same purpose. The LED 72V emits light through the blind hole 48V. The cap 12V, which may be formed of a poly etheramide, is press fitted within the depression 42V with the shoulder portion 24V abutting the step 44V. The LED 72V emits light into the aperture 34V below the red translucent insert 36V.

When the cap 12V is depressed, by an operator, it deforms the actuator block 46V which applies force on the dome actuator 60V thereby engaging and electrically bridging the fixed contact areas **74*a*V, 74*b*V completing an electric circuit. When the pressure on the cap 12V is released, the actuator block 46V** returns to its initial form prior to deformation.

What I claim is:

1. The switch comprising a cap, a base portion, a dome retainer subassembly and a support portion, the base portion having an upper surface and an actuator block, the upper surface having sides forming a depression, the actuator block positioned within the depression, the cap in superposed abutting relation to the upper surface and the actuator block and the cap positioned within the depression, the base portion in superposed abutting relation to the dome retainer subassembly, the dome retainer subassembly having a movable dome contact, the support portion having a facing surface and first and second fixed contacts, the dome contact of dome retainer subassembly in superposed abutting relation to the facing surface, whereby pressure on the cap causes the movable dome contact to electrically engage the first and second fixed contacts and release of the pressure causes the movable dome contact to electrically disengage from the first and second fixed contacts.

2. The switch as set forth in claim 1 wherein the base portion is formed of an elastomeric material.

3. The switch as set forth in claim 1 wherein the dome retainer subassembly comprises a spacer and a membrane seal, the spacer being formed of a double sided adhesive material, one side of which is adhered to the membrane seal.

4. The switch as set forth in claim 1 wherein the facing surface has a printed circuit formed thereon and the first and second fixed contacts being a part of the printed circuit.

5. A switch comprising a cap, a movable contact retainer sub-assembly and a support portion, the base portion having an upper surface and a lower surface and the cap positioned on the upper surface, the base portion in superposed relation to the movable contact retainer sub-assembly, and the contact retainer sub assembly positioned on the support portion, the cap comprising a housing portion having a peripheral edge from which a shoulder portion extends away from the housing portion, the upper surface of the base portion having a series of sides defining a central depression, a hollow actuator block being positioned within the depression, spaced from the sides, an internally shouldered block having an inner lower surface, a first actuator element being formed extending from the inner lower surface, the first actuator element having an actuator surface which lies on the same plane as the lower surface of the base portion, the movable contact retainer sub-assembly comprising a spacer, a membrane seal and a dome actuator, the spacer including adhesive external surfaces, a first through aperture being formed in the spacer, and the dome actuator formed of an electrically conductive material, press fitted into the first through aperture and having a peripheral edge, the first actuator element in superposed relation to the dome actuator, the support portion includes a facing surface on one side thereof and a base surface on the other side thereof, printed circuitry formed on the facing surface for performing the required switching functions, the printed circuitry includes a first fixed contact and a second fixed contact spaced from and circumscribed by the first fixed contact, a first terminal electrically connected to the first fixed contact and a second terminal electrically connected to the second fixed contract, the peripheral edge of the dome actuator bearing against the first fixed contact and the dome actuator in superposed spaced relation to the second fixed contact whereby when the cap is depressed by an operator, the cap deforms the actuator block which in turn applies a force on the dome actuator which engages the second fixed contact and electrically bridges the first and second fixed contacts to complete an electric circuit.

* * * * *